US009673593B2

(12) United States Patent
Kowalski et al.

(10) Patent No.: US 9,673,593 B2
(45) Date of Patent: Jun. 6, 2017

(54) SPARK PLUG HAVING FIRING PAD

(71) Applicant: Federal-Mogul Ignition Company, Southfield, MI (US)

(72) Inventors: Kevin J. Kowalski, Perrysburg, OH (US); Frederick J. Quitmeyer, Rochester Hills, MI (US); Nathan A. Thomson, Southgate, MI (US); Curtis W. Verhoff, Canton, MI (US); Richard L. Keller, Whitehouse, OH (US)

(73) Assignee: Federal-Mogul Ignition Company, Southfield, MI (US)

( * ) Notice: Subject to any disclaimer, the term of this patent is extended or adjusted under 35 U.S.C. 154(b) by 574 days.

(21) Appl. No.: 13/962,496

(22) Filed: Aug. 8, 2013

(65) Prior Publication Data

US 2014/0042892 A1 Feb. 13, 2014

Related U.S. Application Data

(60) Provisional application No. 61/681,289, filed on Aug. 9, 2012, provisional application No. 61/716,250, filed on Oct. 19, 2012, provisional application No. 61/759,088, filed on Jan. 31, 2013.

(51) Int. Cl.

| | |
|---|---|
| ***H01T 21/02*** | (2006.01) |
| ***H01T 13/20*** | (2006.01) |
| *H01T 13/39* | (2006.01) |

(52) U.S. Cl.

CPC ..... *H01T 13/20* (2013.01); *H01T 21/02* (2013.01); *H01T 13/39* (2013.01)

(58) Field of Classification Search

CPC ..... H01T 13/20; H01T 21/02; H01T 13/39

See application file for complete search history.

(56) References Cited

U.S. PATENT DOCUMENTS

| | | | | |
|---|---|---|---|---|
| 4,904,216 | A * | 2/1990 | Kagawa | H01T 21/02 445/7 |
| 5,797,383 | A | 8/1998 | Matsubara et al. | |
| 5,990,602 | A | 11/1999 | Katoh et al. | |
| 6,307,307 | B1 * | 10/2001 | Kanao | H01T 13/20 313/118 |
| 6,337,533 | B1 | 1/2002 | Hanashi et al. | |
| 6,523,515 | B2 | 2/2003 | Kanao | |
| 6,642,638 | B2 | 11/2003 | Ishiguro | |
| 6,676,468 | B2 | 1/2004 | Ishiguro et al. | |
| 6,707,237 | B2 | 3/2004 | Teramura et al. | |
| 6,853,116 | B2 | 2/2005 | Hori et al. | |
| 6,864,623 | B2 | 3/2005 | Ishikawa | |
| 6,923,699 | B2 | 8/2005 | Matsubara et al. | |
| 7,557,495 | B2 | 7/2009 | Tinwell | |
| 7,615,915 | B2 | 11/2009 | Ito et al. | |
| 7,804,232 | B2 | 9/2010 | Kumagai et al. | |
| 7,973,459 | B2 | 7/2011 | Tinwell | |
| 8,106,572 | B2 | 1/2012 | Tanaka et al. | |
| 8,106,573 | B2 | 1/2012 | Boehler et al. | |

(Continued)

*Primary Examiner* — Anh Mai
*Assistant Examiner* — Fatima Farokhrooz
(74) *Attorney, Agent, or Firm* — Reising Ethington, P.C.

(57) ABSTRACT

A spark plug has a firing pad attached to a center electrode or to a ground electrode. The firing pad is attached via laser welding and has a sparking surface with an overall fused area and an unfused area. In one or more embodiments, the overall fused area is located in part or more inboard of a peripheral edge of the firing pad.

21 Claims, 7 Drawing Sheets

(56) References Cited

U.S. PATENT DOCUMENTS

| | | | | |
|---|---|---|---|---|
| 8,115,372 | B2 | 2/2012 | Kameda | |
| 8,203,258 | B2 | 6/2012 | Kameda et al. | |
| 8,212,462 | B2 | 7/2012 | Kato | |
| 8,212,463 | B2 | 7/2012 | Sakayanagi et al. | |
| 2002/0130603 | A1* | 9/2002 | Teramura | H01T 21/02 313/141 |
| 2005/0134160 | A1* | 6/2005 | Yamanaka | H01T 13/39 313/144 |
| 2010/0084391 | A1 | 4/2010 | Nakayama et al. | |
| 2010/0109502 | A1 | 5/2010 | Nakayama et al. | |
| 2010/0213812 | A1* | 8/2010 | Kawashima | B23K 9/0026 313/141 |
| 2010/0247992 | A1* | 9/2010 | Miyata | B23K 26/206 429/94 |
| 2011/0133625 | A1* | 6/2011 | Sakayanagi | H01T 13/32 313/141 |
| 2011/0198981 | A1 | 8/2011 | Kishimoto et al. | |
| 2012/0025690 | A1 | 2/2012 | Kohl | |
| 2012/0025691 | A1 | 2/2012 | Sakayanagi et al. | |
| 2012/0086326 | A1 | 4/2012 | Niessner et al. | |
| 2013/0344302 | A1* | 12/2013 | Helie | B23K 26/0057 428/195.1 |

* cited by examiner

SPARK PLUG HAVING FIRING PAD

REFERENCE TO RELATED APPLICATIONS

This application claims the benefit of U.S. Provisional Ser. Nos. 61/681,289 filed on Aug. 9, 2012, 61/716,250 filed on Oct. 19, 2012, and 61/759,088 filed on Jan. 31, 2013, the entire contents of which are incorporated herein.

TECHNICAL FIELD

This invention generally relates to spark plugs and other ignition devices for internal combustion engines and, in particular, to a firing pad that is welded to a center electrode, to a ground electrode, or to both.

BACKGROUND

Spark plugs can be used to initiate combustion in internal combustion engines. Spark plugs typically ignite a gas, such as an air/fuel mixture, in an engine cylinder or combustion chamber by producing a spark across a spark gap defined between two or more electrodes. Ignition of the gas by the spark causes a combustion reaction in the engine cylinder that is responsible for the power stroke of the engine. The high temperatures, high electrical voltages, rapid repetition of combustion reactions, and the presence of corrosive materials in the combustion gases can create a harsh environment in which the spark plug functions. This harsh environment can contribute to erosion and corrosion of the electrodes that can negatively affect the performance of the spark plug over time, potentially leading to a misfire or some other undesirable condition.

To reduce erosion and corrosion of the spark plug electrodes, various types of noble metals and their alloys—such as those made from platinum and iridium—have been used. These materials, however, can be costly. Thus, spark plug manufacturers sometimes attempt to minimize the amount of precious metals used with an electrode by using such materials only at a firing tip or spark portion of the electrodes where a spark jumps across a spark gap.

SUMMARY

According to one embodiment, a spark plug may include a metallic shell, an insulator, a center electrode, a ground electrode, and a firing pad. The metallic shell has an axial bore. The insulator has an axial bore and is disposed partially or more within the axial bore of the metallic shell. The center electrode is disposed partially or more within the axial bore of the insulator. The ground electrode is attached to the metallic shell. The firing pad has a sparking surface surrounded by a peripheral edge. The firing pad can be attached to the center electrode or to the ground electrode with a weld. The firing pad is exposed to a spark gap. The weld includes one or more fused portion(s) with an overall fused area that is located largely or entirely inboard of the peripheral edge.

According to another embodiment, a spark plug may include a metallic shell, an insulator, a center electrode, a ground electrode, and a firing pad. The metallic shell has an axial bore. The insulator has an axial bore and is disposed partially or more within the axial bore of the metallic shell. The center electrode is disposed partially or more within the axial bore of the insulator. The ground electrode is attached to the metallic shell. The firing pad has a sparking surface surrounded by a peripheral edge. The firing pad can be attached to the center electrode or to the ground electrode with a weld. The firing pad is exposed to a spark gap. The weld includes one or more fused portion(s) located inboard of the peripheral edge, and the sparking surface includes one or more unfused portion(s) located along the peripheral edge so that a majority of the peripheral edge is unfused.

According to another embodiment, a spark plug electrode assembly may include an electrode and a firing pad. The firing pad is attached to the electrode with a weld and has a sparking surface surrounded by a peripheral edge. The weld has a fused portion with a weld starting point and a weld stopping point. The weld starting point, the weld stopping point, or both points are located outboard of the peripheral edge and reside on the electrode. And the sparking surface includes an unfused portion located along the peripheral edge.

According to yet another embodiment, a method of attaching a firing pad to an electrode may include a couple of steps. One step involves applying a laser beam to a sparking surface of the firing pad in order to produce a fused area and an unfused area. The fused area is subject to the application of the laser beam, while the unfused area does not have the laser beam applied to it. Another step in the method involves maintaining the laser beam at the sparking surface so that a weld is formed between the firing pad and the electrode. The laser beam creates one or more fused portion(s) that have an overall fused area that is located largely or entirely inboard of the peripheral edge.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

The firing pads and weld configurations described herein can be used in spark plugs and other ignition devices including industrial plugs, aviation igniters, or any other device that is used to ignite an air/fuel mixture in an engine. This includes spark plugs used in automotive internal combustion engines, and particularly in engines equipped to provide gasoline direct injection (GDI), engines operating under lean burning strategies, engines operating under fuel efficient strategies, engines operating under reduced emission strategies, or a combination of these. The various firing pads and weld configurations may provide improved ignitability, effective pad retention, more lenient manufacturing tolerances, enlarged surface areas for exchanging sparks across a spark gap, and cost effective solutions for the use of noble metal, to cite some possibilities. As used herein, the terms axial, radial, and circumferential describe directions with respect to the generally cylindrical shape of the spark plug of FIG. 1 and generally refer to a center axis A, unless otherwise specified. And, as an aside, the welds and weld configurations shown in the figures are merely illustrative and demonstrative in nature. Actual welds and weld configurations may look different than shown. For example, actual welds and weld configurations may have overlapping pools of weldment material, and may not appear so nicely geometrical as shown.

Figure 1:
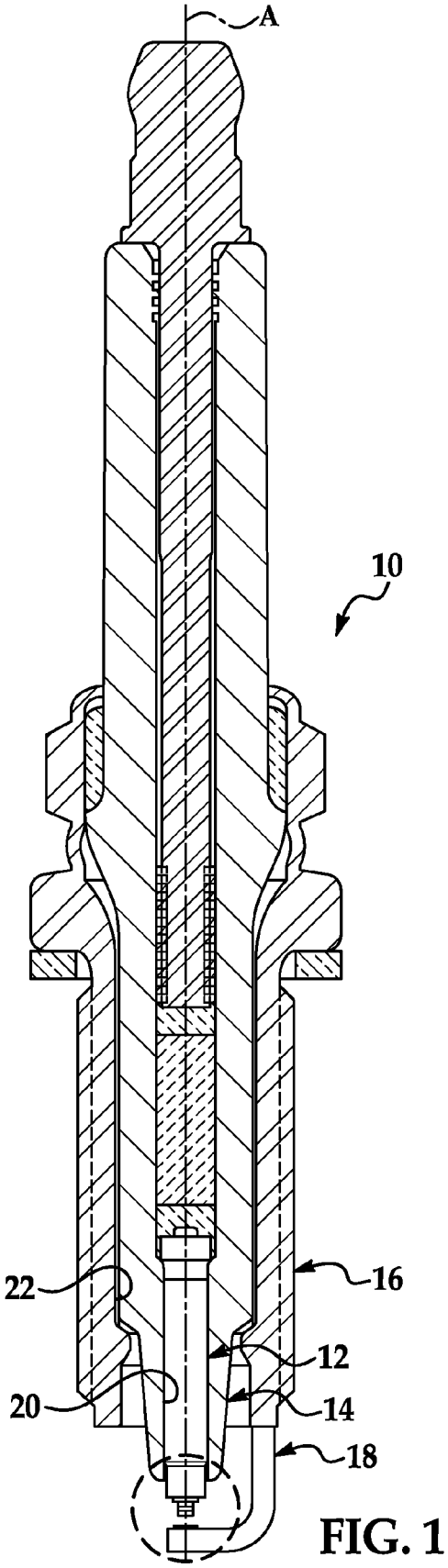
FIG. 1 is a cross-sectional view of an exemplary spark plug.

Referring to FIG. 1, a spark plug 10 includes a center electrode (CE) base or body 12, an insulator 14, a metallic shell 16, and a ground electrode (GE) base or body 18. Other components can include a terminal stud, an internal resistor, various gaskets, and internal seals, all of which are known to those skilled in the art. The CE body 12 is generally disposed within an axial bore 20 of the insulator 14, and has an end portion exposed outside of the insulator at a firing end of the spark plug 10. In one example, the CE body 12 is made of a nickel (Ni) alloy material that serves as an external or cladding portion of the body, and includes a copper (Cu) or Cu alloy material that serves as an internal core of the body; other materials and configurations are possible including a non-cored body of a single material. The insulator 14 is generally disposed within an axial bore 22 of the metallic shell 16, and has an end nose portion exposed outside of the shell at the firing end of the spark plug 10. The insulator 14 is made of a material, such as a ceramic material, that electrically insulates the CE body 12 from the metallic shell 16. The metallic shell 16 provides an outer structure of the spark plug 10, and has threads for installation in the associated engine.

Figure 2:
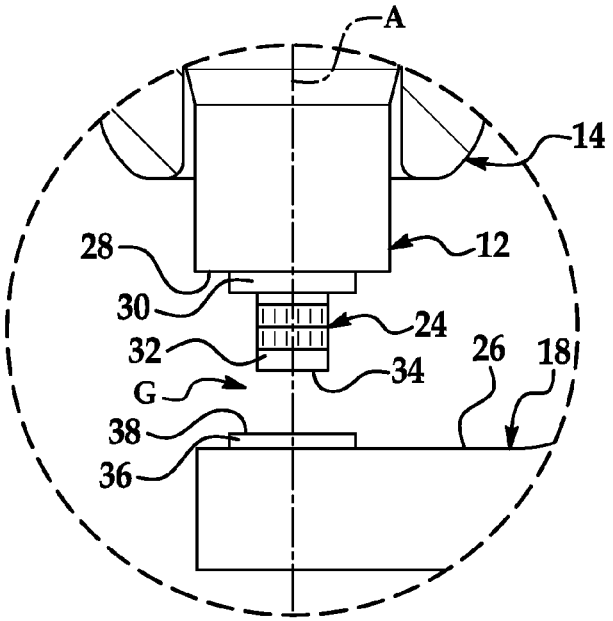
FIG. 2 is an enlarged view of a firing end of the spark plug of FIG. 1, where the firing end includes an exemplary firing pad.

Referring now to FIGS. 1 and 2, the GE body 18 is attached to a free end of the metallic shell 16 and, as a finished product, may have a generally and somewhat conventional L-shape. At an end portion nearest a spark gap G, the GE body 18 is axially spaced from the CE body 12 and from a CE firing tip 24 (if one is provided). Like the CE body, the GE body 18 may be made of a Ni alloy material that serves as an external or cladding portion of the body, and can include a Cu or Cu alloy material that serves as an internal core of the body; other examples are possible including non-cored bodies of a single material. Some non-limiting examples of Ni alloy materials that may be used with the CE body 12, GE body 18, or both, include Ni—Cr alloys such as Inconel® 600 or 601. In cross-sectional profile, the GE body 18 can have a generally rectangular shape or some other suitable configuration. The GE body 18 has an axially-facing working surface 26 that generally confronts and opposes the CE body 12 or the CE firing tip 24 (if one is provided) across the spark gap G. The working surface 26 can be generally planar and without a recess as shown, or it could have a recess or other surface features to accommodate seating of a firing pad, to cite several possibilities.

In the embodiment shown in the figures, the spark plug 10 includes an optional CE firing tip 24 that is attached to an axially-facing working surface 28 of the CE body 12 and exchanges sparks across the spark gap G. Referring to FIG. 2, the CE firing tip 24 shown here has a two-piece and generally rivet-like construction and includes a first piece 30 (rivet head) welded to a second piece 32 (rivet stem). The first piece 30 may be directly attached to the CE body 12, and the second piece 32 may be directly attached to the first piece so that an axially-facing sparking surface 34 is provided for exchanging sparks across the spark gap G. The first piece 30 can be made of a Ni-alloy material, and the second piece 32 can be made of a noble metal-alloy material such those including iridium (Ir), platinum (Pt), or ruthenium (Ru); other materials for these pieces are certainly possible. In other embodiments not shown in the drawings, for example, a separate and discrete CE firing tip is omitted, in which case sparks are exchanged from the CE body itself 12. The optional firing tip 24 could be attached to the GE instead of the CE, it could have a one-piece or single-material construction, and it could have different shapes including non-rivet-like shapes such as cylinders, bars, columns, wires, balls, mounds, cones, flat pads, rings, or sleeves, to cite several possibilities. The present spark plug is not limited to any particular firing end arrangement, as the firing pads and weld configurations described herein could be used with any number of firing end arrangements, including those with or without separate firing tips 24.

Figure 4:
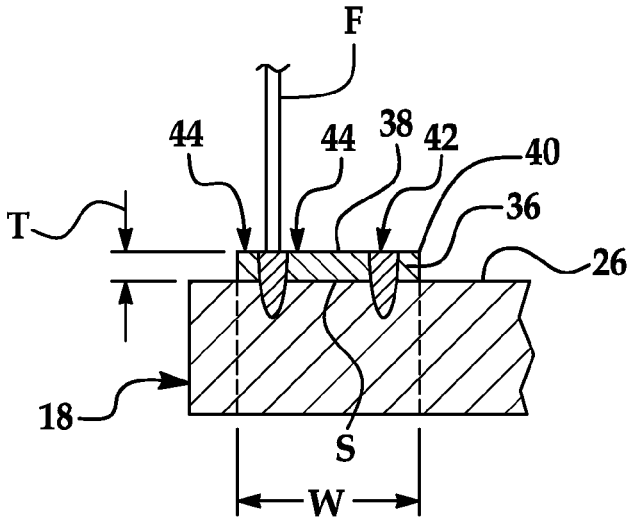
FIG. 4 is an enlarged cross-sectional view of the firing pad of FIG. 2, showing a laser beam of a welding operation.

With reference to FIG. 4, the spark plug 10 includes an exemplary firing pad 36 welded to the working surface 26 of the GE body 18 for exchanging sparks across the spark gap G. The exemplary firing pad 36 is thin in the sense that its greatest width dimension (W) across the sparking surface 38 is at least several times larger than its greatest thickness dimension (T) through the firing pad 36; in the embodiment of FIG. 4, dimension W is measured in the radial direction and dimension (T) is measured in the axial direction so that they are perpendicular, but this is not necessary and depends on the embodiment. This "thin pad" configuration is different than many previously-known firing tip configurations with so-called fine wire constructions in which the greatest width dimension across the sparking surface of the wire (i.e., the diameter) is less than the thickness dimension of the wire (i.e., the axial height). This "thin pad" configuration also gives firing pad 36 a relatively large sparking surface 38 relative to the total amount of precious metal used, particularly when compared to previously-known fine wire tips. Among other possible advantages, the firing pads and weld configurations described herein may provide improved ignitability, effective pad retention, more lenient manufacturing tolerances, enlarged surface areas for exchanging sparks across a spark gap, and cost effective solutions for the use of noble metal, to cite some possibilities. For instance, the large sparking surface 38 can limit material degradation at the working surface 26. The sparking surface 38 directly confronts and opposes a complementary sparking surface on the CE (with or without separate firing tip 24), between which sparks are propagated, discharged, and/or exchanged across the spark gap G during operation of the spark plug 10. It should be appreciated that the weldment illustrated in FIG. 4 extends entirely through the firing pad 36 and penetrates into the ground electrode 18; the amount or distance of penetration may be dictated by the particular application, materials involved, etc. This type of completely penetrating weldment is usually not possible with the so-called fine wire tip constructions.

The firing pad 36 is preferably made from a noble metal material and can be formed into its thin shape before or after it is welded to the electrode body. The firing pad 36 can be made from a pure precious metal or a precious metal alloy, such as those containing platinum (Pt), iridium (Ir), ruthenium (Ru), or some combination thereof. According to some non-limiting examples, the firing pad 36 can be made from a platinum alloy containing between 10 wt % and 30 wt % Ni and the balance being Pt, or one containing between 1 wt % and 10 wt % tungsten (W) and the balance being Pt; in either of the preceding platinum-alloy examples, other materials like Ir, Ru, rhodium (Rh) and/or rhenium (Re) could also be included. Other materials are certainly possible for the firing pad 36, including pure Pt, pure Ir, pure Ru, and any suitable alloy thereof, to name a few. Before being welded to the electrode, the firing pad 36 can be produced by way of various processes and steps including heating, melting, and metalworking. In one example, the firing pad 36 is stamped, cut, or otherwise formed from a thin sheet or tape of noble metal material; in another example, the firing pad is cut or sliced from a wire of noble metal material with a diamond saw or other severing tool, which can then be further flattened or metalworked to refine its shape. The present spark plug is not limited to any particular material or method of manufacturing, as the firing pads and weld configurations described herein could be used with any number of alloy or non-alloy materials or manufacturing methods.

Figure 3A:
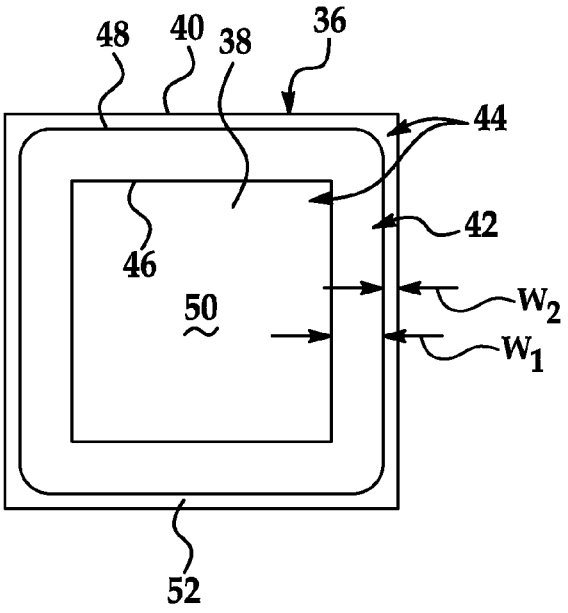
FIGS. 3A-3Q are top views of various embodiments of potential weld configurations for a firing pad, such as the one shown in FIG. 2.
Figure 3B:
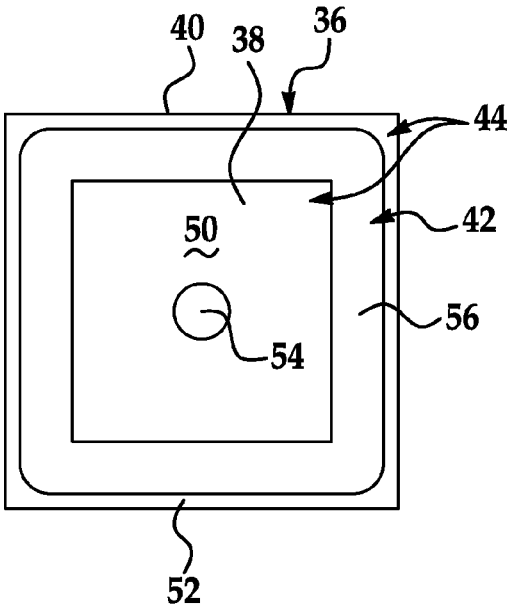
Figure 3C:
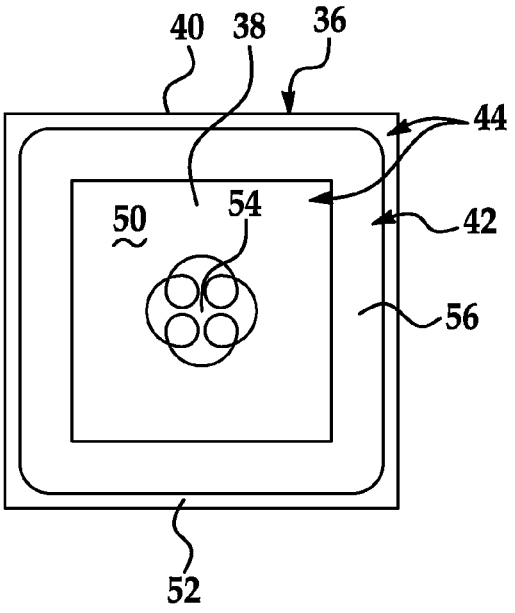
Figure 3D:
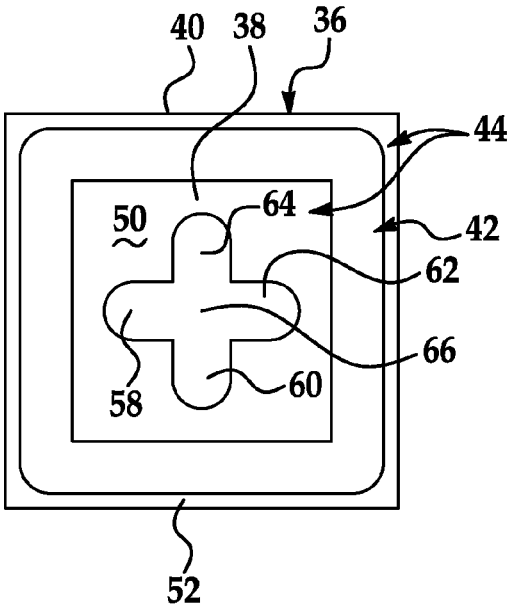
Figure 3E:
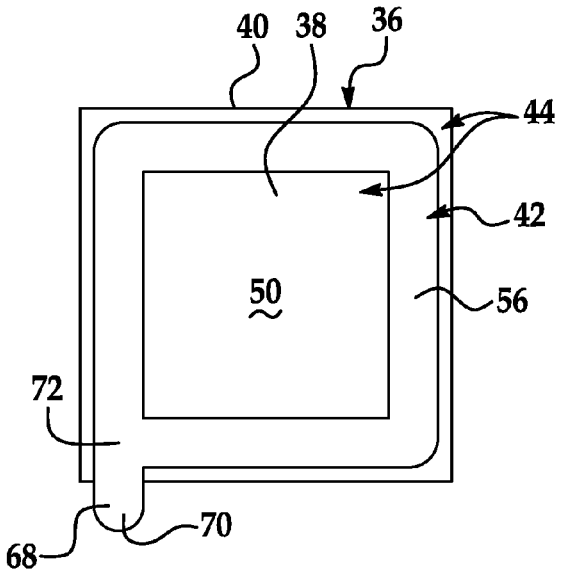
Figure 3F:
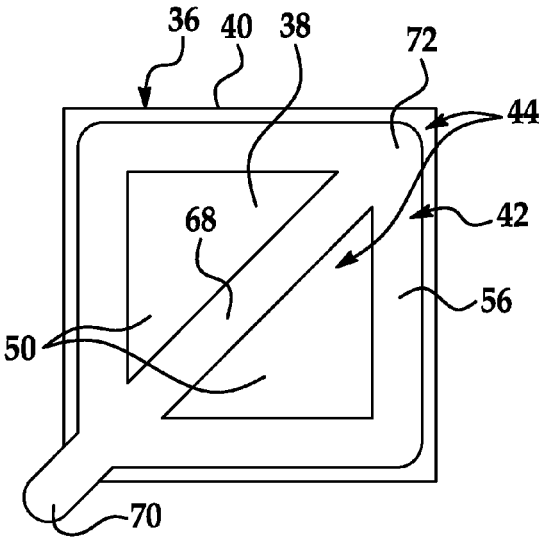
Figure 3G:
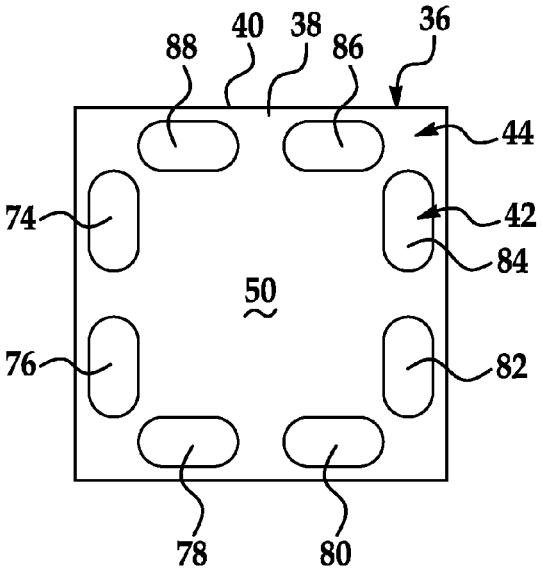
Figure 3H:
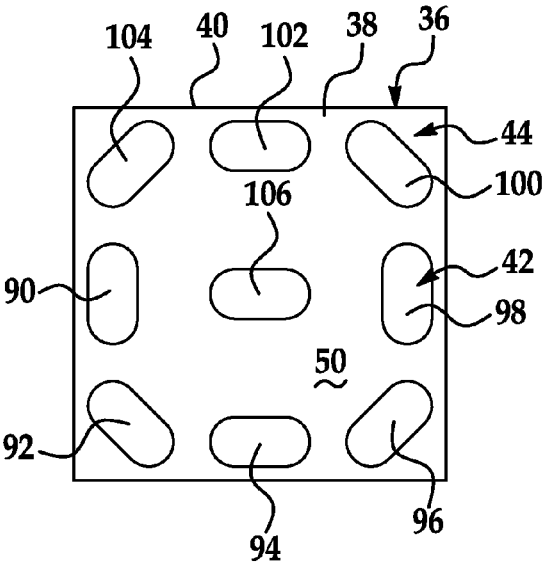
Figure 3I:
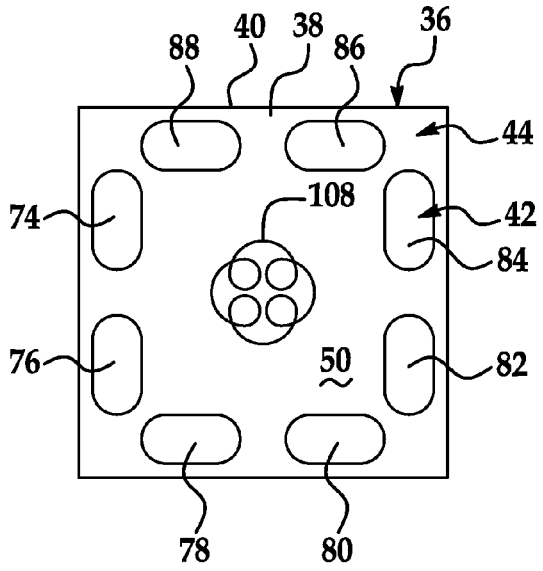
Figure 3J:
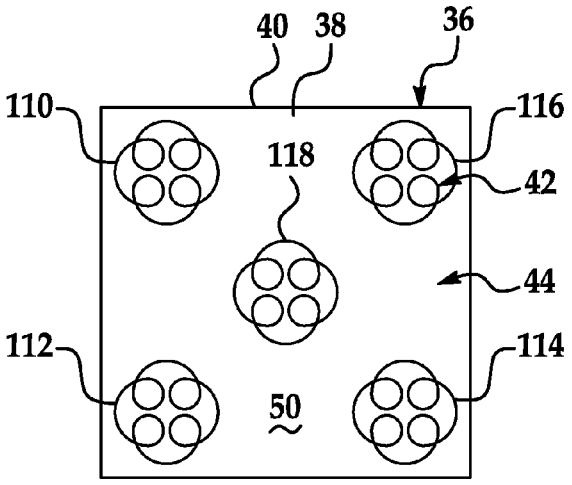
Figure 3K:
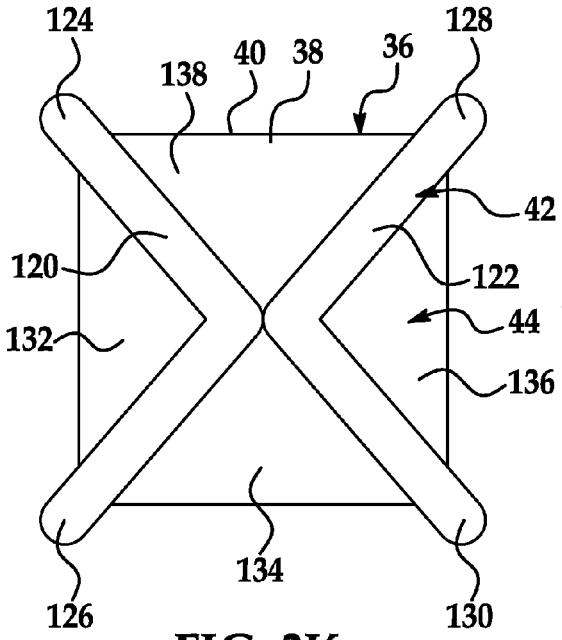
Figure 3L:
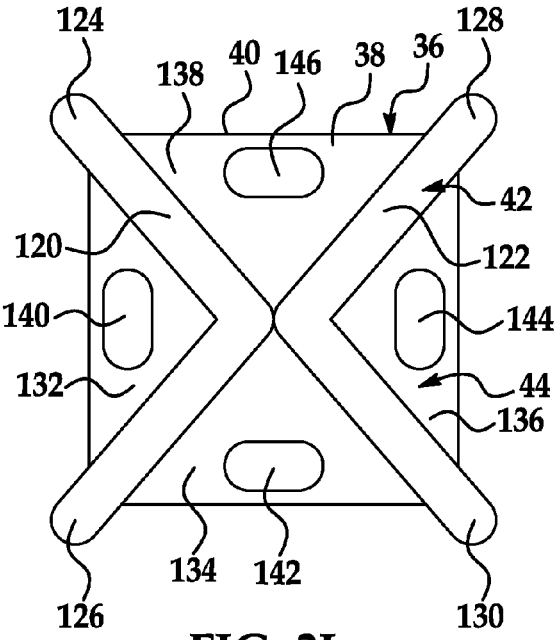
Figure 3M:
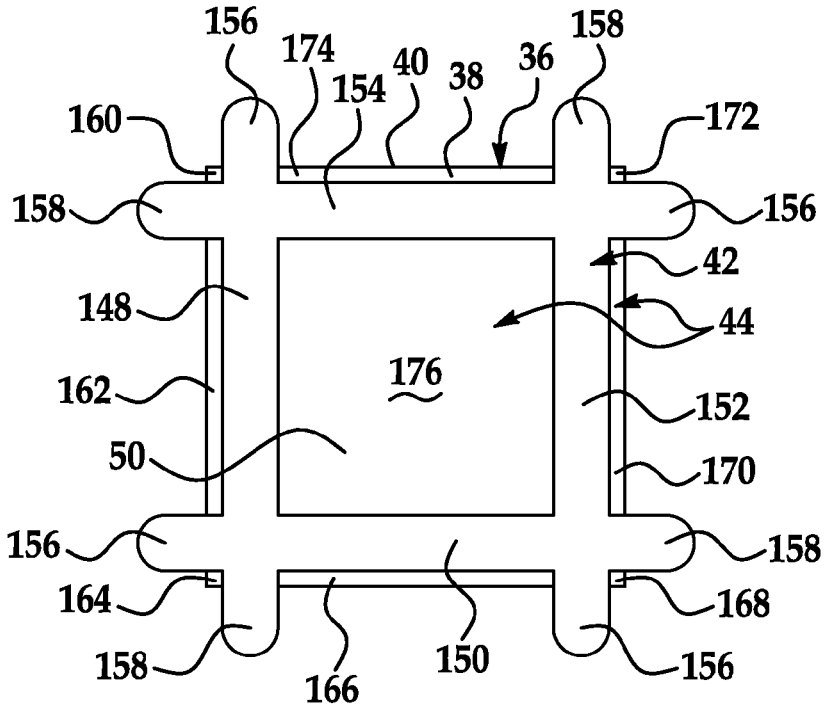
Figure 3N:
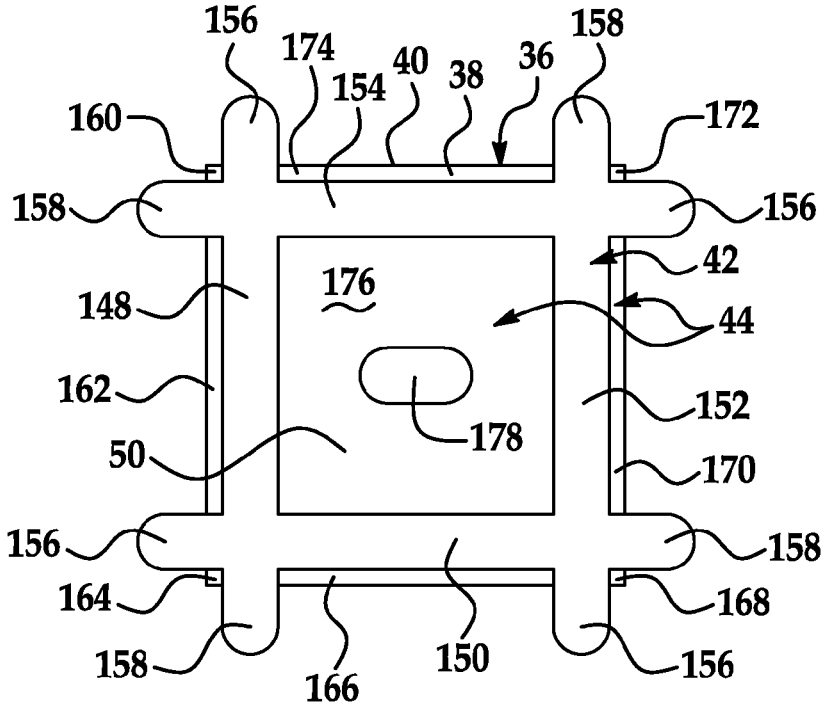
Figure 3O:
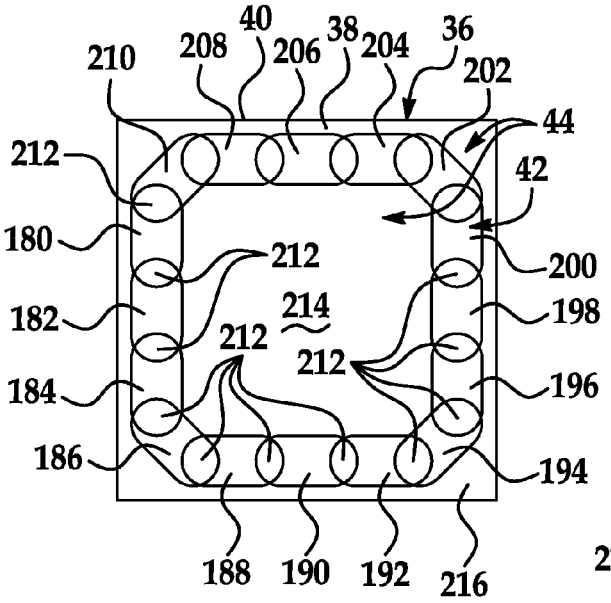
Figure 3P:
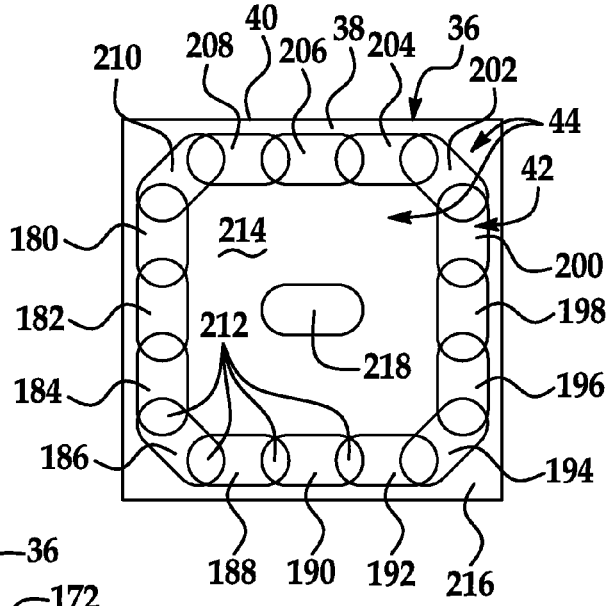
Figure 3Q:
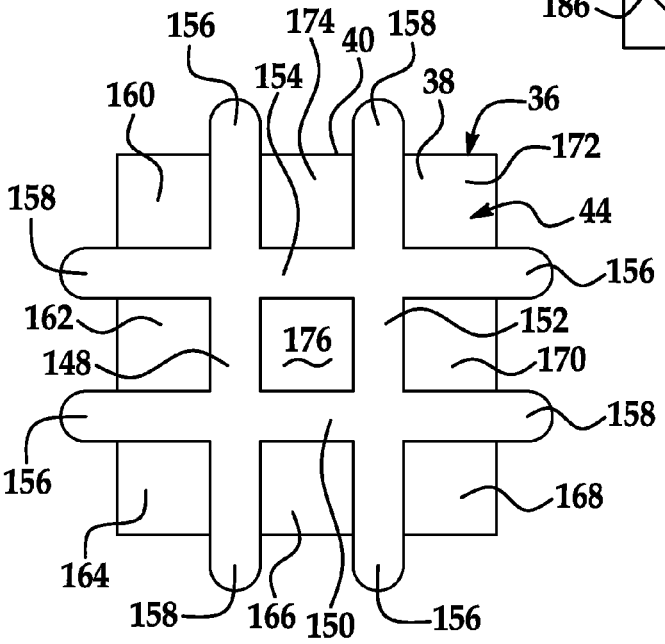

As mentioned, the firing pads and weld configurations described herein and shown in FIGS. 3A-3Q may provide improved ignitability, effective pad retention, more lenient manufacturing tolerances, enlarged surface areas for exchanging sparks across a spark gap, and cost effective solutions for the use of noble metal. These provisions are attributable, at least in part, to a welded or overall fused area 42 that is located mostly, and in some cases entirely, inboard of a peripheral edge 40 of the firing pad 36. This differs from previously-known laser seam welds where, instead of the weld being located mostly or entirely inboard of a peripheral edge, the weld is on top of the entire peripheral edge so that it completely covers the boundary between the firing tip and the electrode body. One potential challenge for forming a laser seam weld like this is that if there is even a slight misalignment or mispositioning of the firing tip or electrode body with respect to each other or with respect to the laser beam (sometimes the result of manufacturing tolerances), the laser can fail to adequately strike the intended junction between the two pieces and can cause retention and dilution problems. For example, the laser might be aimed more toward the electrode body and might only graze the firing tip at its side or might miss it altogether; this can cause a weakened or even ineffective retention between the firing tip and the electrode body. The mispositioning and misalignment can also create a solidified weld pool that is diluted with too much electrode body material and not enough noble metal material. This dilution can hinder sparking performance of the firing tip. The largely inboard weld configurations taught herein, in contrast, can provide consistent and effective welds even when the firing pad, the electrode, and/or the laser is somewhat misaligned or mispositioned, as will be explained.

In the embodiments shown in the figures, the ability to weld mostly and in some cases entirely inboard of the peripheral edge 40 can be attributed, at least in part, to the large surface area of the firing pad 36, the thinness of the firing pad, the welding types and techniques used to attach the firing pad to the CE body 12 and/or GE body 18, or a combination thereof. The inboard weld produces the overall fused area 42 and an unfused area 44 at the sparking surface 38. The overall fused area 42 is generally subject to the intense thermal energy of the impinging laser beam and includes the resulting solidified weldment, while the unfused area 44 is not subject to the same thermal energy and does not include the solidified weldment. The overall fused area 42 may be produced via a non-pulsed or continuous wave (CW) laser, a pulsed laser, a fiber laser, or some other laser or electron beam. In some embodiments, the overall unfused area 44 includes one or more inner unfused portion(s) 50 and one or more outer unfused portion(s) 52. The outer unfused portion 52 may be located between the overall fused area 42 and the peripheral edge 40 of the firing pad 36 (i.e., outer unfused portion 52 is located inboard of the peripheral edge 40 and outboard of fused area 42). The fused and unfused areas 42, 44 can be provided in different configurations, including the various weld configurations shown in FIGS. 3A-3Q.

In the embodiment of FIG. 3A, the overall fused area 42 is confined entirely inboard or radially inward of the peripheral edge 40. The overall fused area 42 includes a fused portion that can be made up of multiple overlapping weld pools in an unbroken and continuous shape that generally follows the peripheral edge 40 without actually crossing the peripheral edge. In this embodiment, the shape of the overall fused area 42 is a square, but it could have a shape that is a circle, oval, rectangle, triangle, diamond, or another shape, which may or may not necessarily depend on the shape of the firing pad 36. The welding process used to produce the overall fused area 42 has weld starting and stopping points somewhere along its unbroken extent and inboard of the peripheral edge 40. The overall fused area 42 is delimited or bounded by an inner edge 46 and an outer edge 48, while the unfused area 44, on the other hand, includes the first or inner unfused portion 50 and the second or outer unfused portion 52. The first unfused portion 50 is located inboard or radially inward of the inner edge 46 and, in this particular embodiment, is completely surrounded and circumscribed by the overall fused area 42. The second unfused portion 52 is located outboard or radially outward of the outer edge 48 so as to form a thin apron or fringe of unfused material around the periphery of the firing pad 36. It should be appreciated that the overall fused area 42 is inwardly spaced from the peripheral edge 40, as opposed to being formed over top of it. Because the fused area 42 shown in FIG. 3A only includes a single fused portion, as opposed to other embodiments that include multiple fused portions, the fused area 42 and the fused portion 42 of FIG. 3A are the same. In examples where a fused area includes multiple fused portions, the overall fused area is the sum or total surface area of the fused portions involved.

The embodiments of FIGS. 3B-3D are similar to the embodiment of FIG. 3A in that they too include an unbroken fused portion 42 that generally follows the peripheral edge 40 of the sparking surface 38 without actually crossing it. Like the previous embodiments, the weld configurations in FIGS. 3B-3D include first and second unfused portions 50, 52, but also include one or more additional fused portions located near the center of the sparking surface 38 to supplement and increase the retention strength of the weld. In FIG. 3B, a second fused portion 54 is produced by a laser applied at the center of the sparking surface 38 for a relatively short amount of time sufficient to penetrate through the firing pad 36 at a single spot thereat. The second fused portion 54 could be located at an off-center position in other embodiments and could be a single shortened weld line produced by a briefly applied moving laser. In this embodiment, the second fused portion 54 is located inboard or radially inward of a first fused portion 56 and is completely surrounded at the sparking surface 38 by the first unfused portion 50. Together, the first and second fused portions 56, 54 constitute the overall fused area 42. In FIG. 3C, the second fused portion 54 is produced by a laser applied near the center of the sparking surface 38 and moved to encircle a centerpoint and make multiple overlapping weld pools in a circular or ring pattern so that the second fused portion 54 is completely surrounded by unfused portion 50. In FIG. 3D, the second fused portion includes four individual fused portions 58, 60, 62, 64 that slightly overlap one another at an overlapping fused junction 66 near the center of the sparking surface 38. The fused portions 58, 60, 62, 64 are shortened weld lines that can have weld starting and stopping points away from the center, at the center, or a combination thereof. In other embodiments, there could be more or less individual fused portions than those shown here, such as six or three fused portions. The fused portions 58, 60, 62, 64 join together to form an integral fused segment that is completely surrounded by the unfused portion 50.

Like the embodiments of FIGS. 3A-3D, the overall fused area 42 in FIGS. 3E and 3F includes a fused portion that generally follows the peripheral edge 40 of the sparking surface 38, but also includes a fused portion that runs over and crosses the peripheral edge 40. In FIG. 3E, a second fused portion 68 extends from the first fused portion 56, crosses over the peripheral edge 40 of the firing pad, and terminates on the underlying electrode body (CE or GE body, depending on the embodiment). The second fused portion 68 can be produced simply by a continuation of the welding process used to produce the first fused portion 56, and need not be the result of a separate welding step, although it could. The welding process could either begin or end at a point 70 (either weld starting point or stopping point), which is located off of the firing pad 36 and on the underlying electrode body; that is, outboard of the peripheral edge 40. Or the weld starting or stopping point could be at a point 72, for example, which is located inboard of the peripheral edge 40 and on the sparking surface 38, or could begin or end at another point. Similarly, in FIG. 3F the second fused portion 68 extends from the first fused portion 56, crosses over the peripheral edge 40, and terminates at a location located off of the firing pad 36, but it also traverses the center of the sparking surface 38 in a diagonal manner. The welding operation of this embodiment could begin or end at the point 70 located off of the sparking surface 38, it could begin or end at the point 72 which is located on the sparking surface, or could begin or end at another point.

The weld configuration embodiments of FIGS. 3G-3I include multiple discrete fused portions that are generally located near the peripheral edge 40 and that generally follow the peripheral edge as a broken line without overlapping it. As is described below, some of the embodiments include additional fused portions located towards the center of the firing pad 36. The individual fused portions are spaced from the peripheral edge 40 and are spaced from one another by sections or parts of the unfused area 44. In FIG. 3G, the overall fused area 42 is made up of eight fused portions 74, 76, 78, 80, 82, 84, 86, and 88; more or less individual fused portions could be provided in other embodiments. Here, a pair of fused portions is located at each of the four sides of the peripheral edge 40 (e.g., portions 74 and 76, portions 78 and 80, and so on). Each of the fused portions 74, 76, 78, 80, 82, 84, 86, and 88 is a shortened weld line produced by a briefly applied moving laser. Although the unfused area 44 is somewhat broken up by the eight fused portions, the unfused area is still mostly intact or integral without isolated or separated unfused portions. In this embodiment, a center section of the sparking surface 38 remains unwelded. In FIG. 3H, the overall fused area 42 is made up of nine fused portions 90, 92, 94, 96, 98, 100, 102, 104, and 106. Here, a single fused portion is located at each of the four sides of the sparking surface 38, a single fused portion is located at each of the four corners of the sparking surface, and a single fused portion 106 is located at the center of the sparking surface 38 and serves as a center stitch. The embodiment of FIG. 3I includes a similar weld configuration as that shown in FIG. 3G, but it also includes a fused portion 108 produced by a laser beam applied at the center of the sparking surface 38 and moved to encircle a centerpoint and make multiple overlapping weld pools in a circular or ring shape.

The embodiment of FIG. 3J has five fused portions 110, 112, 114, 116, and 118 that make up the overall fused area 42, all of which are produced by a laser beam moved to encircle a centerpoint and make a series of overlapping weld pools in a circular or ring shape. Again in this embodiment, the individual fused portions are inboard or spaced radially inward from the peripheral edge 40 via segments of the unfused area 44 and are likewise spaced from one another via the same. The fused portions 110, 112, 114, and 116 are each located at one of the four corners of the sparking surface 38, and the fused portion 118 is located at an approximate center of the sparking surface.

The weld configurations illustrated in FIGS. 3K and 3L share first and second individual fused portions 120, 122 that are generally V-, X-, or U-shaped with a point or apex that may or may not abut or overlap each other near a center of the sparking surface 38. In this particular example, each of the first and second fused portions 120, 122 laps over the peripheral edge 40 at the corners of the sparking surface 38; but this is not necessary. Apart from this corner lap, the first and second fused portions 120, 122 otherwise do not cross the peripheral edge 40 and are largely located inboard of it. Further, each of the first and second fused portions 120, 122 can have weld starting and stopping points that are located off of the sparking surface 38 and on the underlying electrode body. For example, the weld starting or stopping point of the first fused portion 120 can begin or end at a point 124 or at a point 126, and likewise the weld starting or stopping point of the second fused portion 122 can begin or end at a point 128 or at a point 130; of course, other weld starting and stopping points are possible. In both of the embodiments shown, the first and second fused portions 120, 122 divide or partition the unfused area 44 into discrete unfused portions 132, 134, 136, and 138. In the particular embodiment of FIG. 3L, four additional fused portions 140, 142, 144, and 146 are located at one of the four sides of the peripheral edge 40, but each is surrounded by unfused area 44.

Each of the weld configuration embodiments of FIGS. 3M and 3N has four individual and unbroken fused portions 148, 150, 152, and 154 that are linear and overlap two of the other fused portions in a tic-tac-toe or grid-like arrangement. Each of the fused portions 148, 150, 152, and 154 crosses or laps the peripheral edge 40 twice at opposite sides of the firing pad 36. Apart from these lapped sides, the fused portions 148, 150, 152, and 154 do not cross the peripheral edge 40 and are hence located largely inboard of the peripheral edge. Further, each of the fused portions 148, 150, 152, and 154 can have a weld starting and stopping point that is located off of the sparking surface 38 and on the underlying electrode body. For example, the weld starting or stopping point of any one or all of the fused portions 148, 150, 152, and 154 can begin or end at a point 156 or a point 158. In both of the embodiments shown, the fused portions 148, 150, 152, and 154 divide the unfused area 44 into separate unfused portions 160, 162, 164, 166, 168, 170, 172, 174, and 176. In the embodiment of FIG. 3M, the center section of the sparking surface 38 remains unwelded; while in the embodiment of FIG. 3N, a single fused portion 178 is located at the center of the sparking surface 38 and is surrounded by the unfused portion 50.

The weld configuration embodiments of FIGS. 30 and 3P share multiple individual fused portions 180-210 that are located near the peripheral edge 40 and that generally follow the peripheral edge without overlapping it. The fused portions 180-210 are spaced from the peripheral edge 40 via unfused portions, and each fused portion overlaps its two neighboring fused portions (i.e., leading and following fused portions) at an overlapping fused junction 212 so that the whole resembles a chain of linked fused portions. Further, each of the fused portions 180-210 can have a weld starting and stopping point at the respective fused junction. The chain of fused portions 180-210 partition the unfused area 44 into a first or inner unfused portion 214 and a second or outer unfused portion 216. In the embodiment of FIG. 3O, the center section of the sparking surface 38 remains unwelded; while in the embodiment of FIG. 3P, a single fused portion 218 is located at a center of the sparking surface 38 and serves as a center stitch that is surrounded by unfused portion 214.

The weld configuration embodiment of FIG. 3Q is similar in some respects to the configurations of FIGS. 3M and 3N. In FIG. 3Q there are four individual and unbroken fused portions 148, 150, 152, and 154 that are linear and overlap and cross over one another in a tic-tac-toe sort of arrangement. The fused portions 148, 152 can be parallel to each other and do not cross each other, and the fused portions 150, 154 can likewise be parallel and not cross each other. In other embodiments—and depending on the size and shape of the firing pad 36—there can be more or less than the four individual and unbroken fused portions shown in FIGS. 3M, 3N, and 3Q; for example, there could be only two fused portions parallel to each other or crossing each other, there could be three with two parallel fuse portions and one crossing the parallel fused portions, there could be five with three parallel and two parallel with the two crossing the three, or there could be another number of fused portions. Each of the fused portions 148, 150, 152, and 154 crosses or laps the peripheral edge 40 twice at opposite sides of the firing pad 36. Apart from these lapped sides, the fused portions 148, 150, 152, and 154 do not cross the peripheral edge 40 and are hence located largely inboard of the peripheral edge. Further, each of the fused portions 148, 150, 152, and 154 can have a weld starting and stopping point that is located off of the sparking surface 38 and on the underlying electrode body. For example, the weld starting or stopping point of any one or all of the fused portions 148, 150, 152, and 154 can begin or end at a point 156 or a point 158. The fused portions 148, 150, 152, and 154 divide the unfused area 44 into separate unfused portions 160, 162, 164, 166, 168, 170, 172, 174, and 176. Different than the embodiment of FIGS. 3M and 3N, the unfused portions shown in FIG. 3Q can be of substantially the same size and area with respect to one another. This is in part because the fused portions 148, 150, 152, and 154 are spaced to more equally divide the sparking surface 38. In an embodiment somewhat similar to FIG. 3Q, instead of having any unfused portions, the entire sparking surface 38 could be welded (e.g., back and forth laser welder movement) to produce one or more fused portion(s) covering the entire sparking surface.

In the embodiments of FIGS. 3A-3Q above, a majority of the overall fused area 42 is located inboard or radially inward of the peripheral edge 40 of the firing pad 36. Even though in some of the embodiments, a fused portion may cross or lap over the peripheral edge 40, the majority (e.g., greater than 50%) of the overall fused area 42 is still located inboard. This is what is meant by being located "entirely or largely inboard of the peripheral edge." Indeed, in the embodiments where no fused portion extends over the peripheral edge 40 (e.g., FIGS. 3A-D, 3G-J and 3O-P), all of the overall fused area 42 is located inboard of the peripheral edge or boundary (i.e., "entirely inboard"). In those embodiments where one or more fused portions cross over the peripheral edge 40 (e.g., FIGS. 3E-F, 3K-N, and 3Q), the majority of the overall fused area 42 resides inboard of the peripheral edge 40 (e.g., more than 50%, more than 75%, or even more than 90% of the overall fused area), but not all of it. Furthermore, it should be appreciated that in each of the embodiments of FIGS. 3A-3Q, the overall fused area 42 is made up by adding together and combining all of the fused portions in the particular embodiment. And, as described above in some of the embodiments of FIGS. 3A-3Q, the discrete individual fused portions are portions of the overall fused area 42 that are separated and spaced from each other via unfused area so that they do not share the same weld starting and stopping points.

It has been found that in some cases temperature fluctuations and the attendant thermal expansion and contraction may cause separation between the attached firing pad 36 and underlying electrode body. For instance, an edge portion of the firing pad 36 including the peripheral edge 40 may lift off of, and away from, the underlying electrode body, and/or a central portion of the firing pad may lift off of, and bow away from, the underlying electrode body. Although not wishing to be confined to a particular theory of causation, it is currently believed that when separation occurs—if it does indeed occur—it is the result of different rates of thermal expansion and contraction of different metals of the firing pad 36. That is, the mixed material of the overall fused area 42 may have a different rate of thermal expansion and contraction than the material of the unfused area 44. Separation can cause retention problems and can hinder sparking performance.

Some of the weld configurations of FIGS. 3A-3Q have overall fused areas and portions that may minimize or altogether preclude separation between the attached firing pad 36 and underlying electrode body. For example, the centrally-located or centrally-traversing fused portions of FIGS. 3B-3D, 3F, 3H-3L, 3N, 3P, and 3Q can minimize or altogether preclude bowing at the central portion. Similarly, the fused portions that cross the peripheral edge 40 of FIGS. 3E, 3F, 3K, 3L, 3M, 3N, and 3Q can minimize or altogether preclude lifting at the edge portions of the firing pad 36 where the crossing takes place. At least some of the weld configurations of FIGS. 3A-3Q have been found to preclude separation, both lifting edge portions and bowing central portions. For example, the weld configuration of FIG. 3Q has been shown to preclude both lifting edge portions and a bowing central portion. In this particular configuration, it is currently believed that the preclusion is due in part to the spacing of the fused portions 148, 150, 152, and 154 on the sparking surface 38 and relative to one another, and the resulting substantially equal size of the unfused portions 160, 162, 164, 166, 168, 170, 172, 174, and 176. Of course, other factors may contribute to or solely provide the preclusion. And it should be appreciated that weld configurations that lack the centrally-located or centrally-traversing fused portions and that lack fused portions crossing the peripheral edge 40 may still minimize or altogether preclude separation, and it should further be appreciated that separation may not occur in all cases.

Furthermore, in some cases, having weld starting and weld stopping points located off of the sparking surface 38 and on the underlying electrode body may improve or ensure sparking performance, and may minimize or altogether preclude uneven and undesirable spark gap growth. It has been found that initiation of a laser welding process (i.e., weld starting) and cessation of the laser welding process (i.e., weld stopping) may cause relatively forceful movement and stirring of the material struck by the laser beam at that point. And the movement and stirring may thereby form one or more cavities or craters below the immediately surrounding surface level, may form one or more protrusions jutting out above the surrounding surface level, may produce porosity at the welding starting/stopping point, or may result in a combination of these consequences. If formed to a great enough extent on the sparking surface 38, these consequences can sometimes hinder sparking performance and bring about uneven and undesirable spark gap growth. Accordingly, initiating and ending the laser welding process off of the sparking surface 38 and instead on the underlying electrode body may improve or ensure desired sparking performance and may minimize or altogether preclude uneven and undesirable spark gap growth. Nonetheless, it should be appreciated that weld configurations with weld starting and stopping points on the sparking surface 38 may still improve or ensure desired sparking performance and may still minimize or altogether preclude uneven and undesirable spark gap growth.

The firing pad 36 can be attached to the GE body 18 or the CE body 12 by a number of welding types, techniques, processes, steps, etc. The exact attachment method employed can depend upon, among other considerations, the materials used for the firing pad 36 and for the underlying electrode body, and the exact shape and size of the firing pad. In one example, the firing pad 36 is preliminarily resistance welded or tack welded to the electrode body for a non-primary or temporary retention against the electrode body. In the resistance welding example, a pair of protrusions or rails can be provided on and can project from a bottom surface of the firing pad 36. The rails can be linear and can span completely across the extent of the bottom surface, though need not. During the resistance welding process, electrical current flow is focused and concentrated through the rails, and hence heat generated at the rails is increased. In this way, resistance welding is facilitated at the rails and a stronger weld is focused between the firing pad 36 and the GE body 18. This may also help inhibit or altogether eliminate separation between the firing pad 36 and the GE body 18 during use in application. Furthermore, the firing pad 36 can be subjected to a cleaning process in which oil, dirt, and other contaminants are removed from the pad's outer surface. This too may facilitate welding and the formation of a stronger weld. Of course, the rails need not be provided, and cleaning need not be performed.

After the resistance weld, if indeed performed, the firing pad 36 is laser welded to the electrode body for a primary and more permanent retention that forms the various welding configurations shown herein. In other examples, resistance welding need not be performed, in which case a mechanical clamp or other temporary holding technique could be used to keep the firing pad in place during laser welding. A fiber laser welding type and technique can be performed for the weld configuration embodiments herein, as well as other laser welding types and techniques such as Nd:YAG, $CO_2$, diode, disk, and hybrid laser techniques, with or without shielding gas. In the fiber laser example, the fiber laser emits a relatively concentrated beam that can create a keyhole opening weld; other laser beams can also produce a suitably concentrated beam and keyhole opening weld.

Referring now to FIG. 4, the laser weld is shown extending entirely through the firing pad 36 so that the overall fused area 42 and unfused area 44 are formed. A laser beam F impinges or strikes the sparking surface 38 at a point of entry, penetrates entirely through the thickness T of the firing pad 36, and extends into the electrode body. The materials of the firing pad 36 and the electrode body can melt and mix together as the thermal energy from the laser beam F increases at a surface-to-surface interface S between the firing pad and the electrode body. The laser beam F can be aimed at an orthogonal angle relative to the sparking surface 38 as shown, or at another non-orthogonal angle. The precise composition of the resulting fused portions or weldments can vary within the interior of the weld so that there is a greater ratio of pad material to electrode material near the sparking surface 38, which can aid sparking performance. When there are greater proportions of pad material at the sparking surface 38, the firing pad 36 and weld configurations described herein can provide a greater effective sparking surface area capable of exchanging sparks, compared to some previously-known firing tips. Another potential advantage of the firing pad and welding configurations shown herein is that they allow for more lenient manufacturing tolerances. For instance, if the laser beam F in FIG. 4 is slightly misaligned so that it strikes the firing pad 36 slightly to the right or slightly to the left of that shown, it is likely that a suitable weld will still be formed through the firing pad. In those spark plugs where a laser beam is being directed precisely at the boundary or junction between a firing tip and electrode, the tolerances are typically not so generous. Moreover, the firing pad 36 provides a large sparking surface 38, particularly when compared to the amount of noble or precious metal used in the firing pad.

The firing pad and weld configurations described herein may possess certain geometric properties and can satisfy certain relationships that help provide improved ignitability, effective pad retention, lenient manufacturing tolerances, enlarged sparking surface areas, and cost effective solutions. For example, in any of the embodiments shown in FIGS. 3A-Q, the overall fused area 42 may include a fused portion having a width dimension between approximately 0.14 mm and 0.30 mm, inclusive of the lower and upper limits (see width $W_1$ in FIG. 3A as an example). In another example, the unfused area 44 can include an outer unfused portion that is located between a fused portion and the peripheral edge 40 and has a width dimension between approximately 0.03 mm and 0.08 mm, or between approximately 0.03 mm and 0.13 mm, inclusive of the lower and upper limit values (see width $W_2$ in FIG. 3A as an example). In an example relationship, the unfused portion described immediately above can have a width value $W_2$ that is greater than or equal to approximately 10% of the average thickness of the firing pad 36 (e.g., approximately 40% of the average thickness T of the firing pad). In another exemplary relationship, the unfused portion can have a width value $W_2$ that is less than or equal to approximately 50% of the width of the laser beam or laser spot that is used to attach the firing pad to the electrode body (e.g., approximately 30% of the width of the laser weld beam). Other dimensions, relationships, etc., are certainly possible, as the preceding examples only represent some of the possibilities.

Figure 5:
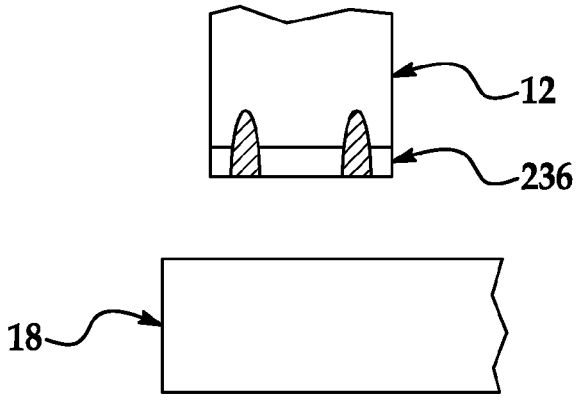
FIG. 5 is an enlarged view of a firing end of a spark plug, where the firing end includes an exemplary firing pad attached to a center electrode.
Figure 6:
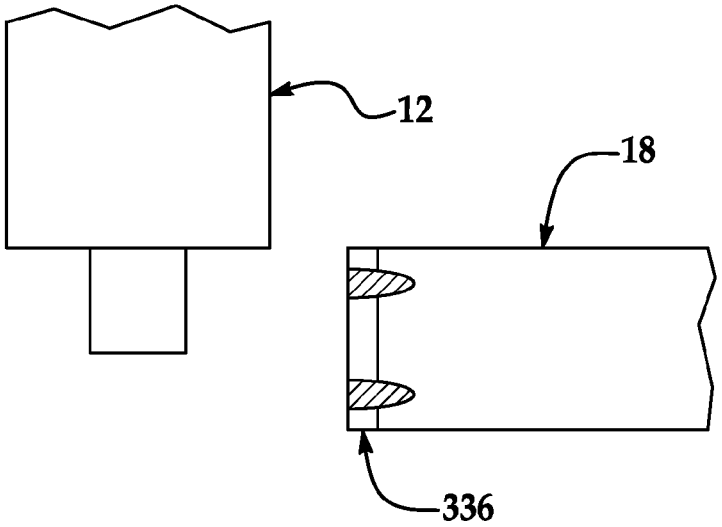
FIG. 6 is an enlarged view of a firing end of a spark plug, where the firing end includes an exemplary firing pad attached to a distal end of a ground electrode.

In other embodiments, the firing pad 36 could be provided and attached to the underlying electrode in a variety of ways. For example, in the embodiment of FIG. 5, a firing pad 236 could be welded directly or indirectly (e.g., via an intermediate piece) to the CE body 12 instead of being welded to the GE body 18. Or, according to the embodiment of FIG. 6, a firing pad 336 could be welded directly or indirectly to a distal end surface of the GE body 18, in which case a radially-directed spark gap would be located between the firing pad and CE body or CE firing tip. In yet another embodiment, which is not shown in the drawings, the firing pad could be joined directly or indirectly to both the GE body and the CE body. These are only some of the possibilities, as the firing pad 36 could have different shapes, configurations, and arrangements. For example, the firing pad 36 could have a rectangular shape, a circular shape, an oval shape, or an irregular shape, and with these different shapes the firing pad could have any of the weld configurations of FIGS. 3A-3Q. The firing pad 36 could be arranged in an angular offset or diamond orientation (e.g., 45°) with respect to the lengthwise extent of the GE body 18, and the end portion of the GE body could be trimmed or narrowed on its sides to form what-is-sometimes-referred-to as a V-trim.

Some thermal testing was performed in order to observe retention performance between the firing pad 36 and an electrode body. In the testing, the firing pad 36 and electrode body were attached to each other via the weld configuration embodiment of FIG. 3Q. In general, the thermal testing subjected the firing pad 36, electrode body, and overall fused area 42 to an increased temperature for a relatively abbreviated period of time, and then allowed them to cool to ambient temperature. The testing was meant to simulate expansion and contraction thermal stresses that are more extreme than those experienced in application in a typical internal combustion engine. In the example testing conducted, a sample spark plug was mounted in a collar-like structure made of brass material. The collar structure was secured to the shell of the sample spark plug and did not make direct abutment with the electrode body; the mount structure acted as a heat sink and facilitated cooling. An induction heater was then used to heat the attached firing pad 36 and electrode body up to 1,700° F. for about 20 seconds. After that, the firing pad 36 and electrode body were allowed to cool at rest down to about room temperature or slightly above room temperature. This rise and fall in temperature constituted a single test cycle, and the thermal testing was conducted on numerous sample spark plugs. On average, the sample spark plugs were capable of enduring over one-hundred-and-seventy-five cycles without exhibiting significant cracking, separation, or other conditions that could negatively impact retention between the firing pad 36 and the electrode body. One-hundred-and-seventy-five cycles is considerably greater than the one-hundred-and-twenty-five cycles oftentimes for such products deemed acceptable, and was unexpected in view of how thin the firing pads were. The cycles endured in the testing here is also comparable to pads with much greater thicknesses than the thin firing pads tested—this too was unexpected. It should be appreciated that not all testing will yield these exact results, as different testing parameters, samples, equipment, as well as other factors, can alter the outcome of testing performance.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A spark plug, comprising:

a metallic shell having an axial bore;

an insulator having an axial bore and being disposed at least partially within the axial bore of the metallic shell;

a center electrode being disposed at least partially within the axial bore of the insulator;

a ground electrode being attached to the metallic shell; and a firing pad having a sparking surface surrounded by a peripheral edge and being attached to the center electrode or to the ground electrode with a weld so that the firing pad is exposed to a spark gap, wherein the weld includes one or more fused portion(s) on the sparking surface with an overall fused area that is located largely or entirely inboard of the peripheral edge of the firing pad.

2. A spark plug as defined in claim 1, wherein the firing pad is a thin pad that has a greatest width dimension (W) that is at least several times larger than a greatest thickness dimension (T).

3. A spark plug as defined in claim 1, wherein the sparking surface includes one or more first unfused portion(s) located at the peripheral edge and the weld includes one or more first fused portion(s) located entirely inboard of the first unfused portion(s), and the first fused portion(s) are configured to follow the shape of at least a section of the peripheral edge to prevent lifting of the firing pad at the peripheral edge.

4. A spark plug as defined in claim 1, wherein the weld includes one or more fused portion(s) with a weld starting point and a weld stopping point, and the fused portion(s) cross over the peripheral edge of the firing pad so that at least one of the weld starting point or the weld stopping point is located outboard of the peripheral edge and does not reside on the sparking surface of the firing pad.

5. A spark plug as defined in claim 1, wherein the weld includes one or more fused portion(s) produced by a laser beam applied to a point on the sparking surface of the firing pad and moved around to encircle the point and make multiple overlapping weld pools in a circular or ring shape.

6. A spark plug as defined in claim 1, wherein the weld includes a first fused portion located largely or entirely inboard of the peripheral edge and a second fused portion located largely or entirely inboard of the peripheral edge, and the first and second fused portions are separate fused portions that cross one another at an overlapping fused junction located on the sparking surface of the firing pad.

7. A spark plug as defined in claim 1, wherein at least one of the fused portion(s) has a width value ($W_1$) ranging between approximately 0.14 mm and approximately 0.30 mm, inclusive.

8. A spark plug as defined in claim 1, wherein the firing pad is a thin pad made of a noble metal-alloy material that includes at least one noble metal selected from the group consisting of: iridium (Ir), platinum (Pt), palladium (Pd), ruthenium (Ru), or rhodium (Rh).

9. A spark plug as defined in claim 1, wherein the weld includes one or more fused portion(s) with an overall fused area that is located entirely inboard of the peripheral edge of the firing pad, and the sparking surface includes one or more unfused portion(s) located between the peripheral edge and the fused portion(s).

10. A spark plug as defined in claim 2, wherein the firing pad is attached to the center electrode or to the ground electrode with a keyhole weld that is formed by a fiber laser and penetrates entirely through a thickness of the firing pad and through a surface-to-surface interface (S) between the firing pad and the underlying center or ground electrode.

11. A spark plug as defined in claim 3, wherein at least one of the first unfused portion(s) has a width value ($W_2$) ranging between approximately 0.03 mm and approximately 0.08 mm, inclusive.

12. A spark plug as defined in claim 3, wherein at least one of the first unfused portion(s) has a width value ($W_2$) that is greater than or equal to approximately 10% of the average thickness of the firing pad.

13. A spark plug as defined in claim 3, wherein at least one of the first unfused portion(s) has a width value that is less than or equal to approximately 50% of the width of a laser beam used to form the weld that attaches the firing pad to the center electrode or to the ground electrode.

14. A spark plug as defined in claim 3, wherein the one or more first fused portion(s) include a plurality of discrete and individual fused portions that are short linear weld segments generally arranged as one or more broken line(s) located entirely inboard of the peripheral edge.

15. A spark plug as defined in claim 3, wherein the weld further includes one or more second fused portion(s) located inboard of the first fused portion(s) and near a center of the sparking surface, and the second fused portion(s) are configured to prevent bowing of the firing pad at the center.

16. A spark plug as defined in claim 6, wherein the first and second fused portions are linear fused portions that extend between different corners of the firing pad, and the first and second fused portions are generally configured so that they are perpendicular to one another and form a V-, Y- or X-shape on the sparking surface of the firing pad.

17. A spark plug as defined in claim 6, wherein the weld further includes third and fourth fused portions, the first and third fused portions extend across the sparking surface of the firing pad and are generally parallel to one another, the second and fourth fused portions extend across the sparking surface of the firing pad and are generally parallel to one another and perpendicular to the first and third fused portions, and the fused portions are generally configured so that they form a grid-like arrangement on the sparking surface of the firing pad.

18. A spark plug as defined in claim 17, wherein each of the first, second, third and fourth fused portions crosses over the peripheral edge of the firing pad so that at least one of a weld starting point or a weld stopping point for each fused portion is located outboard of the peripheral edge and does not reside on the sparking surface of the firing pad.

19. A spark plug as defined in claim 17, wherein the first, second, third and fourth fused portions divide the sparking surface of the firing pad into at least nine separate and discrete unfused portions that are separated from one another and are generally the same size as one another.

20. A spark plug, comprising:

a metallic shell having an axial bore;

an insulator having an axial bore and being disposed at least partially within the axial bore of the metallic shell;

a center electrode being disposed at least partially within the axial bore of the insulator;

a ground electrode being attached to the metallic shell; and a firing pad having a sparking surface surrounded by a peripheral edge and being attached to the center electrode or to the ground electrode with a weld so that the firing pad is exposed to a spark gap, wherein the weld includes one or more fused portion(s) on the sparking surface located inboard of the peripheral edge and the sparking surface includes one or more unfused portion(s) located along the peripheral edge so that a majority of the peripheral edge is unfused.

21. A spark plug electrode assembly, comprising:

an electrode; and a firing pad attached to the electrode with a weld, and the firing pad having a sparking surface surrounded by a peripheral edge and the weld having a fused portion on the sparking surface with a weld starting point and a weld stopping point, wherein the weld starting point, the weld stopping point, or both are located outboard of the peripheral edge and reside on the electrode, and the sparking surface includes an unfused portion located along the peripheral edge.

* * * * *